United States Patent [19]

Aoki et al.

[11] Patent Number: 4,525,384

[45] Date of Patent: Jun. 25, 1985

[54] PROCESS FOR PRODUCING WHOLLY AROMATIC POLYAMIDE FILAMENTS HEAT-TREATED UNDER TENSION

[75] Inventors: Akihiro Aoki; Shozaburo Hiratsuka, both of Iwakuni; Norihisa Yamaguchi, Mihara; Shoji Makino, Ibaraki, all of Japan

[73] Assignee: Teijin Limited, Osaka, Japan

[21] Appl. No.: 586,792

[22] Filed: Mar. 6, 1984

[30] Foreign Application Priority Data

| | | | |
|---|---|---|---|
| Mar. 7, 1983 | [JP] | Japan | 58-35774 |
| Mar. 23, 1983 | [JP] | Japan | 58-47269 |
| Jul. 7, 1983 | [JP] | Japan | 58-122279 |
| Aug. 26, 1983 | [JP] | Japan | 58-154915 |
| Aug. 26, 1983 | [JP] | Japan | 58-154916 |

[51] Int. Cl.[3] ..... B29C 25/00

[52] U.S. Cl. ..... 427/174; 427/171; 427/176; 264/131; 264/174

[58] Field of Search ..... 427/174, 171, 176; 264/131, 174, 210.3

[56] References Cited

U.S. PATENT DOCUMENTS

| | | | |
|---|---|---|---|
| 3,140,957 | 7/1964 | Tanabe et al. | 264/210.3 |
| 3,975,482 | 8/1976 | Rulison | 427/174 |
| 4,196,118 | 4/1980 | Fujie et al. | 524/606 |
| 4,320,081 | 3/1982 | Lammers | 524/606 |

FOREIGN PATENT DOCUMENTS

| | | | |
|---|---|---|---|
| 47-21601 | 6/1972 | Japan | 264/131 |
| 52-66724 | 6/1977 | Japan | 264/210.3 |

*Primary Examiner*—Lewis T. Jacobs

*Attorney, Agent, or Firm*—Burgess, Ryan & Wayne

[57] ABSTRACT

In a process for producing heat-treated wholly aromatic polyamide filaments comprising at least one wholly aromatic polyamide having recurring units of the formula (I):

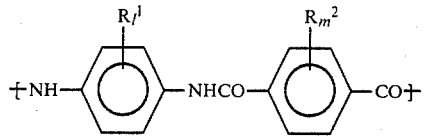

(I)

and at least one type of recurring units selected from those of the formula (II):

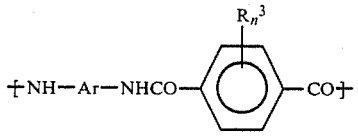

(II)

where Ar represents a divalent aromatic radical selected from those of the formulae (III) and (IV):

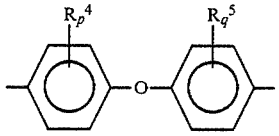

(III)

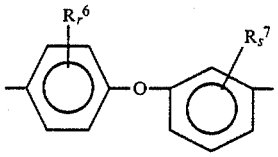

(IV)

and $R^1$, $R^2$, $R^3$, $R^4$, $R^5$, $R^6$ and $R^7$ respectively represent independently from each other, a substituent selected from the group consisting of halogen atoms and alkyl radicals having 1 to 2 carbon atoms, and l, m, n, p, q, r, and s respectively represent, independently from each other, zero or an integer of 1 to 2, the sum of the recurring units of the formulae (I) and (II) corresponding to at least 80 molar % of the overall recurring units in the wholly aromatic polyamide, undesirable adhesion of individual filaments to each other is satisfactorily prevented by adhering fine particles of an inert inorganic material which consists essentially of at least one member selected from the group consisting of graphite, talc, colloidal silica, hydrophobic silica, and mica, and optionally, of hydrated aluminum silicate, to peripheral surfaces of the individual non-heat treated filaments and thereafter, by heat treating under tension or drawing the filaments.

17 Claims, No Drawings

PROCESS FOR PRODUCING WHOLLY AROMATIC POLYAMIDE FILAMENTS HEAT-TREATED UNDER TENSION

BACKGROUND OF THE INVENTION

1. Field of the Invention

The present invention relates to a process for producing wholly aromatic polyamide filaments heat-treated under tension. More particularly, the present invention relates to a process for producing wholly aromatic polyamide filaments heat-treated under tension without undesirable breakage of the individual filaments during the heat treating procedure under tension.

2. Description of the Prior Art

Recently, various industries need various types of synthetic filaments having highly improved properties, for example, a high tensile strength and modulus of elasticity. In order to reply to these needs, the fiber industry is attempting to develop and supply a new type of synthetic filaments having enhanced properties.

In the process for producing the new type of synthetic filaments, a certain type of filaments are subjected to a heat-treatment under tension, for instance, a drawing procedure at a high draw ratio at a high temperature, to enhance the properties thereof. Sometimes, the drawing and/or heat treatment procedures under tension result in undesirable adhesion of the individual filaments to each other. In other words, when a number of filaments in the form of a bundle are drawn and/or heat-treated under tension at an elevated temperature, they adhere to each other so that the resultant filament bundle exhibits a decreased usefulness, whereas each of the individual filaments exhibits improved properties.

For example, it is known that in order to obtain aromatic polyamide filaments having an excellent mechanical strength and modulus of elasticity, undrawn aromatic copolyamide filaments, as disclosed in British Patent No. 1,501,948, containing recurring units having a para-divalent aromatic radical and an ether radical as a copolymerized component, are drawn at a high draw ratio of 6.0 or more at a high temperature of 300° C. or more. In the drawing procedures, the undrawn filaments are gradually stretched in a so-called flow drawing condition without the occurrence of necking.

However, in the flow drawing procedure at a high temperature, the undrawn filaments are significantly softened and adhere to each other. This adhering phenomenon is promoted with an increase in the number of individual filaments in the filament bundle and results in a decrease in the drawability of the filament bundle. Also, the resultant drawn filament bundle exhibits poor flexibility.

Japanese Unexamined Patent Publication (Kokai) No. 58-54021 (1983) discloses a method for preventing the undesirable adhesion of the individual filaments to each other in the drawing and/or heat-treatment procedures by applying an inorganic compound, for example, hydrated aluminum silicate, which method is capable of forming a hydrated gel onto peripheral surfaces of the filaments before the drawing procedures.

In the above-mentioned method, however, it was found by the inventors of the present invention that, when the method was applied to a filament bundle consisting of large number of individual filaments, the adhesion-preventing effect for the individual filaments was unsatisfactory. It was also found by the inventors of the present invention that the reasons for the above-mentioned unsatisfactory adhesion-preventing effect reside in the fact that when an aqueous dispersion of the hydrated gel-forming inorganic compound applied onto the peripheral surfaces of the filaments is dried, the decrease in the amount of water in the aqueous dispersion results in the deposition of inorganic compound particles, and then in the undesirable aggregation of the inorganic compound particles to form coarse particles on the peripheral surfaces of the filaments. The aggregation phenomenon results in uneven covering of the filament peripheral surface with the inorganic compound particles. The phenomenon of the uneven covering is promoted together with an increase in the number of individual flaments contained in the filament bundle.

Under the above-mentioned circumstances, it has been greatly desired to provide a new process for drawing a wholly aromatic filament bundle even at a high temperature and at a high draw ratio without adhesion of the individual filaments to each other.

SUMMARY OF THE INVENTION

An object of the present invention is to provide a process for producing wholly aromatic polyamide filaments which have been heat-treated under tension, for example, drawn, without adhesion of the individual filaments to each other even at a high temperature.

Another object of the present invention is to provide a process for producing heat-treated wholly aromatic polyamide filaments under tension, in which process the individual filaments are protected from undesirable adhesion to each other at a high temperature of, for example, from 300° C. to 600° C., and the resultant heat-treated filaments exhibit improved softness and other properties.

The above-mentioned objects are attained by the process of the present invention comprising the steps of adhering fine particles consisting essentially of an inert inorganic material to the peripheral surfaces of non-heat treated wholly aromatic polymide filaments comprising at least one wholly aromatic polyamide having recurring units of the formula (I):

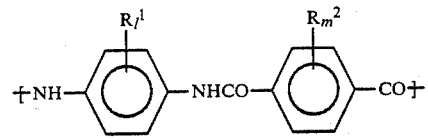

(I)

and at least one type of recurring unit selected from those of the formula (II):

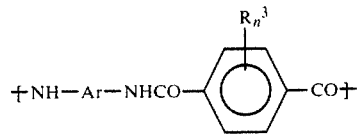

(II)

wherein Ar represents a divalent aromatic radical selected from those of the formulae (III) and (IV):

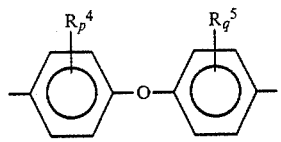

(III)

-continued

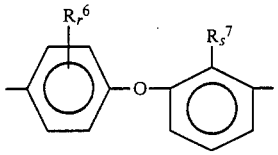

(IV)

and $R^1$, $R^2$, $R^3$, $R^4$, $R^5$, $R^6$, and $R^7$ represent respectively, independently from each other, a substituent selected from the group consisting of halogen atoms and alkyl radicals having 1 to 2 carbon atoms, and l, m, n, p, q, r, and s represent respectively, independently from each other, zero or an integer of 1 to 2, the sum of the recurring units of the formulae (I) and (II) corresponding to at least 80 molar % of the overall recurring units in the wholly aromatic polyamide, to an extent that the peripheral surfaces of the non-heat treated filaments are uniformly covered by the inert inorganic material fine particles; and heat-treating under tension the non-heat treated filaments covered with the inert inorganic material fine particles at a temperature of 300° C. or more, in which process the adhering operation is carried out by applying an aqueous liquid containing the inert inorganic material and then by drying the applied aqueous liquid on the non-heat treated filaments, and the inert inorganic material consists essentially of at least one member selected from the group consisting of graphite, talc, colloidal silica, hydrophobic silica, and mica.

DESCRIPTION OF THE PREFERRED EMBODIMENTS

The process of the present invention is specifically applied to non-heat treated wholly aromatic polyamide filaments for example, undrawn or partially drawn filaments, comprising at least one wholly aromatic polymide having at least 80 molar % of the sum of recurring units of the formula (I):

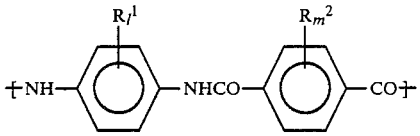

(I)

and at least one type of recurring units selected from those of the formula (II):

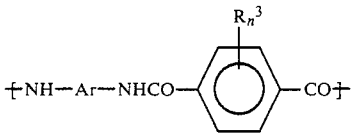

(II)

wherein Ar represents a divalent aromatic radical selected from those of the formulae (III) and (IV):

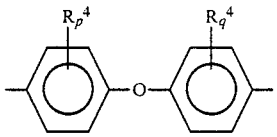

(III)

and

-continued

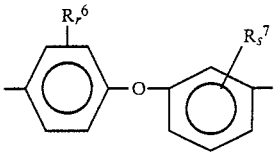

(IV)

$R^1$, $R^2$, $R^3$, $R^4$, $R^5$, $R^6$, and $R^7$ represent respectively, independently from each other, a substituent selected from the group consisting of halogen atoms, for example, chlorine atoms, and alkyl radicals having 1 to 2 carbon atoms such as methyl and ethyl radicals, and l, m, n, p, q, r, and s represent respectively, independently from each other, zero or an integer of 1 to 2.

In the wholly aromatic polyamide, the content of the recurring units of the formula (I) is preferably in the range of from 20 to 85 molar %.

Also, the content of the recurring units of the formula (II) is preferably in the range of from 15 to 80 molar %.

Especially, the content of the recurring units of the formula (II) wherein the divalent aromatic radical Ar is of the formula (IV) is preferably in the range of from 15 to 80 molar %, more preferably from 30 to 70 molar %.

The aromatic polyamide usable for the present invention may contain 20 molar % or less of additional recurring units other than those of the formulae (I) and (II).

The additional recurring units may be selected from those of the formulae (V) and (VI):

$$\text{-[NH—Ar}_1\text{—CO]-} \quad \text{(V)}$$

and $$\text{-[NH—Ar}_2\text{—NHCO—Ar}_3\text{—CO]-} \quad \text{(VI)}$$

wherein Ar, $Ar_2$, and $Ar_3$ respectively represent, independently from each other, an unsubstituted or substituted divalent aromatic radical selected from those of the formulae (VII) to (X):

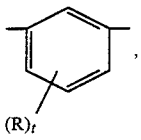

(VII)

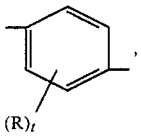

(VIII)

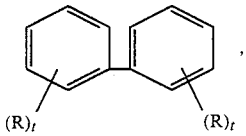

(IX)

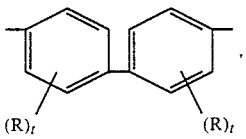

(X)

wherein R represents a member selected from the group consisting of lower alkyl radicals having 1 to 2 carbon atoms, lower alkoxy radicals having 1 to 2 carbon atoms, halogen atoms and a nitro radical, t represents zero or an integer of from 1 to 2, and $Ar_2$ being not the radicals of the formula (XIII) when $Ar_3$ is a radical of the formula

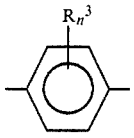

The non-heat treated filaments usable for the present invention are produced from a dope solution containing the above-mentioned specific wholly aromatic polyamide by means of usual wet, dry, or dry-jet-spinning process.

In the process of the present invention, fine particles of an inert inorganic material are adhered to the peripheral surface of the non-heat treated aromatic polyamide filaments.

The inert inorganic material must be chemically stable at an elevated heat-treating temperature of 300° C. or more and must be not chemically reactive with the aromatic polyamide filaments. For example, it is necessary that the inert inorganic material does not oxidize the aromatic polyamide filament even at the heat-treating temperature.

The inert inorganic material adhered on the peripheral surfaces of the non-heat treated filaments is in the form of fine particles preferably having an average size of 10 microns or less, more preferably 5 microns or less. When the average size of the fine particles is 10 microns or less, the inert inorganic material is uniformly distributed on the non-heat treated filament surfaces and is very effective for preventing the adhesion of the individual filaments to each other in the heat-treating stage under tension, for example, the drawing stage.

The inert inorganic material usable for the process of the present invention consists essentially of at least one member selected from the group consisting of graphite, talc, colloidal silica, hydrophobic silica, and mica.

In the process of the present invention, the inert inorganic material fine particles adhere preferably in an amount of from 0.01% to 5%, more preferably, from 0.1% to 2% by anhydrous weight, based on the weight of the non-heat treated filaments.

When the amount of the inert inorganic material fine particles is excessively small, the adhesion of the filaments to each other during the drawing and/or heat treatment steps cannot be satisfactorily prevented. Also, an excessive amount of the inert inorganic material adhered to the non-heat treated filaments is not only ineffective for additionally enhancing the adhesion-preventing effect of the adhered inert inorganic material, but also has a tendency to separate from the filament surfaces during the filament winding and processing processes so as to soil the filament moving path. Also, the excessive amount of inert inorganic material results in a reduction in the bonding property of drawn filaments to various coating materials, for example, rubber and/or synthetic resin materials, when the drawn filaments are used as a reinforcing material for articles comprising the rubber and/or synthetic resin materials.

In order to adhere the inert inorganic material fine particles to the non-heat treated filaments, the inert inorganic material fine particles are dispersed in water or are dissolved to provide an aqueous colloidal solution, the resultant aqueous liquid containing the inert inorganic material is applied to the peripheral surfaces of the non-heat treated filaments and the resultant dispersion or colloidal solution layers on the filament surfaces are dried so as to form fine particles of the inert inorganic material evenly distributed on the filament surfaces.

The aqueous liquid containing the inert inorganic material may additionally contain a converging (bundling) agent comprising hydrated aluminum silicate. The converging agent is effective for preventing undesirable opening of the filament bundle, in other words, undesirable separation of individual filaments from each other, in the heat-treating step. For example, a preferable aqueous liquid for the process of the present invention contains a mixture of from 50% to 95% by weight of talc and from 5% to 50% by weight of hydrated aluminum silicate.

The converging agent may be applied separately from the inert inorganic material to the non-heat treated filament surfaces. That is, the applying procedure of the aqueous liquid containing the inert inorganic material alone may be followed by applying an aqueous liquid containing the bundling agent comprising hydrated aluminum silicate.

The above-mentioned applying procedure of the aqueous liquid containing the converging agent comprising hydrated aluminum silicate may be further followed by applying an aqueous liquid containing an additional converging agent comprising a polyalkyleneglycol to the filament surfaces. The additional converging agent is effective for enhancing the opening-preventing effect of the converging agent comprising hydrated aluminum silicate. The polyalkyleneglycol may be selected from polyethylene glycol, and copolymers of ethyleneglycol and propyleneglycol preferably having a molar ratio of ethyleneglycol to propyleneglycol of from 70:30 or more. It is preferable that the polyalkyleneglycols have a molecular weight of 1000 or more and be soluble in water. Also, it is preferable that the above-mentioned polyalkyleneglycols be capable of sublimating at a heat-treating or drawing temperature of 400° C. or more. Therefore, when the non-heat treated filaments are heat-treated under tension or drawn at a temperature of 400° C. or more, the surfaces of the resultant filaments become free from the polyalkyleneglycols.

The procedure for applying the aqueous liquid containing the inert inorganic material and the converging agent comprising hydrated aluminum silicate may be followed by applying an aqueous liquid containing an additional converging agent comprising a polyalkyleneglycol to the peripheral surfaces of the non-heat treated filaments.

The aqueous liquid containing the inert inorganic material fine particles may additionally contain a dispersing agent comprising sodium metaphosphate. The sodium metaphosphate is specifically effective for stably dispersing the inert inorganic material in water, and is usually contained in a concentration of from 0.1% to 5% by weight based on the weight of the inert inorganic material fine particles.

Generally, it is preferable that the converging agent is used in such an amount that the hydrated aluminum silicate adheres in an amount of from 0.01% to 3% based on the weight of the filaments to the filament surfaces.

Also, it is preferable that the additional converging agent is used in such an amount that polyalkyleneglycol adheres in an amount of from 0.01% to 3% based on the weight of the filaments, to the filament surfaces.

The aqueous liquid may further contain a sizing agent in addition to the inert inorganic material. The sizing agent is effective for controlling the viscosity of the aqueous dispersion or colloidal solution to a desired level, for restricting undesirable precipitation of the inert inorganic material particles, and for enhancing cohesion of the filaments to each other. The sizing agent is also effective for preventing undesirable breakage of the individual filaments and undesirable production of fibril in the filament bundle in the drawing process, so as to improve the productivity of the drawn filaments.

The sizing agent may be selected from conventional sizing agents usable for filament materials, especially, polyester filament material. However, it is preferable that the sizing agent is chemically stable and is not deteriorated even when it is heated at an elevated temperature of 300° C. or more.

For example, the sizing agent is preferably selected from polyalkyleneglycol type sizing agents usable for polyester filaments and/or polyamide filaments.

In the application of the aqueous liquid containing the inert inorganic material, a bundle of the non-heat treated filaments is continuously immersed in the aqueous liquid for a certain time period and then is squeezed by means of squeezing rolls or so that a desired amount of the aqueous liquid is remained in the filament bundle. This method is effective for uniformly applying the aqueous liquid to the non-heat treated filament surfaces. Otherwise, the non-heat treated filament bundle is continuously brought into contact with a liquid-applying roll of the same type as that of a usual oiling roll.

The inert inorganic material may be a mixture of hydrophilic colloidal material such as colloidal silica or colloidal mica which is capable of forming a hydrophilic gel with a hydrophobic colloidal inorganic material, for example, hydrophobic silica or colloidal graphite.

The above-mentioned hydrophilic colloidal substances exhibit a satisfactory affinity to the filament surfaces. However, they have an undesirable tendency toward aggregating and the resultant coarse particles of the hydrophilic substance adhere unevenly to the filament surfaces. This phenomenon results in a decrease in the adhesion-preventing effect of the inert inorganic material. The hydrophobic colloidal substances exhibit a poor affinity to the filament surfaces. Due to this undesirable property, it is difficult to uniformly distribute the hydrophobic colloidal particles on the filament surfaces.

The above-mentioned disadvantages can be eliminated by applying the hydrophilic colloidal substance together with the hydrophobic colloidal substance to the filament surfaces. In this manner, the hydrophobic colloidal particles are covered by the hydrophilic colloid particles so as to stabilize the dispersion of the hydrophobic colloidal particles in water; to decrease the electric charge of the hydrophilic colloidal particles, which charge causes the hydrophobic colloidal particles to aggregate with each other, and therefore, to prevent the aggregation of hydrophobic colloid particles.

The hydrophobic silica usable for the present invention is produced by converting hydroxyl groups located in the surface portions of silica particles to organic trimethylsiloxyl groups. The hydrophobic silica particles have inert surfaces which are not chemically reactive to the non-heat treated aromatic polyamide filaments even when the filaments are heated at an elevated temperature of 300° C. or more. Therefore, the hydrophobic silica does not cause the aromatic polyamide filaments to be deteriorated in the heat-treating stage.

The hydrophobic silica particles per se can be dispersed in water in the presence of a surface active agent consisting of at least one member selected from nonionic surface active agents, for example, an addition reaction product of an organic compound having 8 to 22 carbon atoms with ethylene oxide; anionic surface active agents, for example, having at least one phosphoric acid group, sulfuric acid group or sulfonic acid group; cationic surface active agents, for example, having an ammonium group; and ampholytic surface active agents having an anionic group and a cationic group.

Usually, the weight ratio of the hydrophilic colloidal material to the hydrophobic colloidal material is in the range of from 10:1 to 10,000:1. In the above-mentioned range of the weight ratio, the individual particle surfaces of the hydrophobic colloidal material are satisfactorily covered with the hydrophilic colloidal particles.

The aqueous liquid layers containing the inert inorganic material and formed on the non-heat treated filament surfaces are dried preferably at a temperature of from 80° C. to 300° C. by using a conventional drying apparatus for a filament bundle, to form fine particles of the inert inorganic material adhered to the non-heat treated filament surfaces.

The non-heat treated filaments are then subjected to a heat-treating step under tension at a temperature of 300° C. or more, preferably, from 300° C. to 550° C. The heat-treating step may be a single or two or more stage drawing step at a total draw ratio of, for example, 6 or more, at a temperature of at least 300° C. Also, the heat-treating operation may be carried out under tension without substantial elongation of the filaments. The heat-treating or drawing operation can be effected by a conventional drawing method. For example, the drawing operation may be carried out by bringing undrawn or partially drawn filaments covered by the inert inorganic material fine particles into contact with a heating plate having a temperature of from 300° C. to 550° C., while the filaments pass through a heat-treating path at a predetermined speed. The contact time is usually in the range of from 0.1 to 5 seconds. The heat-treating or drawing operation may be carried out by passing the undrawn filaments covered by the inert inorganic material fine particles through a heating atmosphere having a temperature of from 300° C. to 600° C., at a predetermined speed. In this type of heat-treating or drawing operation, the filaments do not come in contact with any solid while they are heat-treated or drawn. The residing time of filaments in the heating atmosphere is usually at least 0.2 seconds, preferably, from 0.3 to 2.0 seconds.

In the above-mentioned non-contact heat-treating or drawing operation, the filaments may pass through a hollow heating furnace filled with a heating gas which is non-reactive with the filaments and the inert inorganic material. The non-reactive gas can be selected from steam, nitrogen, carbon dioxide gases, and mixtures of two or more of the above-mentioned gases.

In another type of non-contact heat-treating or drawing operation, a non-reactive heating gas is blown toward the filaments moving along a predetermined moving path.

The heat-treating under tension or drawing operation may be carried out in a single step or in two or more steps.

Where the non-reactive heating gas is jetted toward the filaments, it is most important to control the velocity of the heating gas jet, especially in the direction normal to the moving path of the filaments. An increase in the velocity of the heating gas jet will result in an increase in the boundary film heat transfer coefficient between the filaments and the heating gas, so that the temperature of the filaments rapidly reach a predetermined level. Therefore, it becomes possible to satisfactorily heat-treat or draw the filaments even by using a heating furnace having a relatively short length. Also, the heating gas jet blown toward the filaments is effective for opening the filaments so as to evenly heat the filaments. However, an excessively large velocity of the heating gas jet sometimes results in a disadvantageous uneven heating of the filaments due to an adiabatic expansion and uneven decrease in temperature of the jetted heating gas, and damage of the filaments due to the strong impact of the heating gas jet applied to the filaments. Usually, the relative velocity of the heating gas jet to the moving filaments is preferably in the range of from 0.1 to 100 m/sec, more preferably from 0.5 to 10 m/sec.

The temperature of the heating gas is preferably in the range of from 20° C. to 100° C. above a predetermined level of temperature, and the temperature of filaments should reach this level in the heat-treating or drawing operation.

The heat-treating operation under tension, for example, drawing operation at a temperature of 300° C. or more, preferably from 400° C. to 600° C., may follow a preliminary heat-treating operation, for example, a partial drawing operation applied to the undrawn filaments at a temperature of below 300° C. at a partial draw ratio of from 1.1 to 2.0.

The drawing operation at a temperature of 300° C. or more is carried out preferably at a total draw ratio of 6.0 or more, more preferably 8.0 or more so as to provide drawn aromatic polyamide filaments having an excellent tensile strength and modulus of elasticity. The resultant heat-treated or drawn filaments are finally wound on a bobbin or drum.

The process of the present invention is effective for heat-treating under tension, for instance, drawing at a predetermined draw ratio, non-heat treated wholly aromatic polyamide filaments without adhesion of the individual filaments to each other, even at a high temperature of 300° C. or more at a high draw ratio, for example, of 3.0 or more, preferably 6.0 or more. The resultant heat-treated or drawn filaments have a satisfactory appearance and exhibit an excellent tensile strength and modulus of elasticity. The process of the present invention is especially valuable for drawing undrawn or partially drawn wholly aromatic polyamide filament bundles consisting of a number of individual filaments, without breakage of the individual filaments and without the formation of fluff.

The specific examples presented below will serve to more fully elaborate how the present invention is practiced. However, it should be understood that these examples are only illustrative and in no way limit the scope of the present invention.

In these examples, the inherent viscosity (IV) of an aromatic polyamide polymer was determined at a temperature of 30° C. by using an Ostwald's viscometer and a solution of the polymer dissolved in a concentration (C) of 0.5 g/dl in a solvent consisting of 97.5% sulfuric acid, in accordance with the equation (I):

$$IV = \frac{l_n(t/t_0)}{C}\ dl/g \qquad \text{(I)}$$

wherein $t_0$ represents a flowing down time (control) of the solvent and t represents a flowing down time of the polymer solution.

The tensile strength in g/d, ultimate elongation in %, and Young's modulus in g/d of the filaments were determined from a stress-strain curve of the filaments measured by using an Instron tester at a stretching speed of 10 cm/min at a temperature of 20° C. and at a relative humidity of 65% on an initial test length of the specimen.

The degree of adhesion of individual filaments resulting from heat-treating under tension, for example, drawing procedure applied to a non-heat treated filament bundle consisting of a number of individual filaments was determined in the following manner.

The entire number (N) of the individual filaments in the filament bundle was counted. After the non-heat treated filament bundle was subjected to a heat-treatment under tension, for example, drawing procedure, the number (n) of the individual filaments separated from the heat-treated (drawn) filament bundle was counted. That is, when a plurality of individual filaments adhere to each other to form a body of thread, they were counted as one. The degree of adhesion of the individual filaments (f) was calculated in accordance with the equation (II):

$$f = \frac{N}{n} \qquad \text{(II)}$$

the degree of adhesion was represented by an average of values resulted from five different portions of the bundle.

EXAMPLES 1 AND 2 AND COMPARATIVE EXAMPLE 1

In Example 1, a wholly aromatic polyamide consisting of:

(1) 50 molar % of recurring units of the formula,

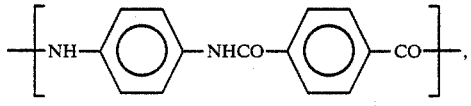

and (2) 50 molar % of recurring units of the formula,

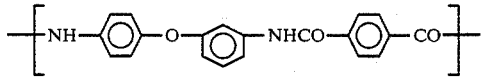

was prepared. The resultant polyamide had an inherent viscosity of 3.1.

The polyamide was dissolved in a concentration of 6% by weight in an N-methy-2-pyrrolidone solvent containing a small amount of calcium chloride ($CaCl_2$). The resultant dope solution was extruded through a spinneret having 1000 holes, each having a diameter of 0.2 mm, at an extruding rate of 940 g/min. The resultant filamentary streams of the dope solution were forwarded about 10 mm in an ambient air atmosphere and then introduced into a coagulating liquid consisting of 30% by weight of N-methyl-2-pyrrolidone and 70% by weight of water at a temperature of 50° C. to coagulate them into undrawn filaments. The coagulated undrawn filaments were withdrawn from the coagulating liquid at a speed of 30 m/min and then washed with water at a temperature of 50° C.

The washed undrawn filaments were immersed in an aqueous liquid which was prepared by mixing 10 liters of an aqueous coloidal solution of 2% by weight of hydrated aluminum silicate (which was available under the trademark of Osoms-N made by Siraishi Kogyo Co., Ltd, Japan and which is in the form of fine particles having an average size of 5 microns or less) with 2.2 ml of an aqueous colloidal solution of 2.2% by weight of graphite, were squeezed by using nip-rollers, and then were dried by using drying rolls. The dried undrawn filament surfaces were covered by the mixture of fine particles of hydrated aluminum silicate and graphite, in an amount of approximately 5% based on the weight of the dried undrawn filaments.

The undrawn filaments were drawn on a heating plate at a temperature of 500° C. and at a draw ratio of 12, and the drawn filaments were oiled and finally wound on a bobbin in accordance with the usual process.

The properties of the resultant drawn filaments are indicated in Table 1.

In Comparative Example 1, the same procedures as those described in Example 1 were carried out, except that no graphite was contained in the aqueous liquid. The properties of the resultant drawn filaments are shown in Table 1.

In Example 2, the same procedures as those described in Example 1 were carried out, except that hydrated aluminum silicate was replaced by colloidal silica. The properties of the resultant drawn filaments are indicated in Table 1.

TABLE 1

| Item | Example 1 | Comparative Example 1 | Example 2 |
|---|---|---|---|
| Thickness (d) | 1480 | 1475 | 1481 |
| Tensile strength (g/d) | 26.0 | 25.4 | 25.9 |
| Ultimate elongation (%) | 4.1 | 4.0 | 4.1 |
| Initial modulus of elasticity (g/d) | 630 | 628 | 620 |
| Degree of adhesion | 1.01 | 1.85 | 1.08 |

EXAMPLES 3 AND 4 AND COMPARATIVE EXAMPLES 2 AND 3

In Example 3, the same procedures as those described in Example 1 were carried out except that the wholly aromatic polyamide consisted of:

(1) 30 molar % of recurring units of the formula,

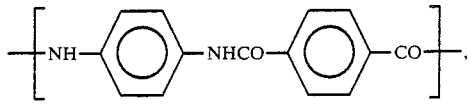

(2) 30 molar % of recurring units of the formula,

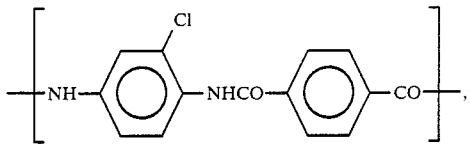

and (3) 40 molar % of recurring units of the formula,

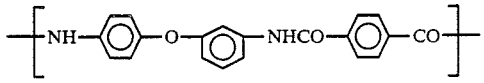

and had an inherent viscosity of 3.2, the dope solution contained 5.0% by weight of the polyamide, and the drawing operation was carried out at a heating plate temperature of 490° C. at a draw ratio of 11.5.

The properties of the resultant drawn filaments are shown in Table 2.

In Comparative Example 2, the same procedures as those mentioned in Example 3 were carried out, except that no graphite was used. The properties of the resultant drawn filaments are indicated in Table 2.

In Example 4, the same procedures as those of Example 3 were carried out except that the wholly aromatic polyamide consisted of (1) 50 molar % of recurring units of the formula,

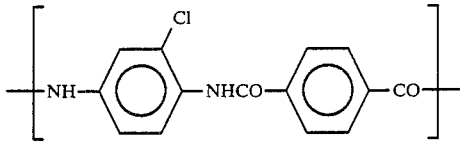

and (2) 50 molar % of recurring units of the formula,

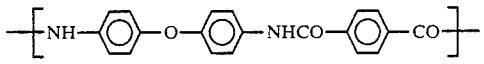

and had an inherent viscosity of 3.4. The drawing operation was carried out at a heating plate temperature of 450° C. and at a draw ratio of 8.5.

In Comparative Example 3, the same procedure as those described in Example 4 were conducted except that no graphite was used.

The properties of the resultant drawn filaments are indicated in Table 2.

TABLE 2

| Item | Example 3 | Comparative Example 2 | Example 4 | Comparative Example 3 |
|---|---|---|---|---|
| Thickness (d) | 1325 | 1330 | 1520 | 1515 |

TABLE 2-continued

| Item | Example 3 | Comparative Example 2 | Example 4 | Comparative Example 3 |
|---|---|---|---|---|
| Tensile strength (g/d) | 23.8 | 22.4 | 19.2 | 19.0 |
| Ultimate elongation (%) | 3.7 | 3.6 | 3.4 | 3.2 |
| Initial modulus of elasticity (g/d) | 570 | 550 | 540 | 520 |
| Degree of adhesion | 1.00 | 2.35 | 1.02 | 2.03 |

EXAMPLE 5 AND COMPARATIVE EXAMPLE 4

In Example 5, the same procedures as those disclosed in Example 1 were carried out, except that the aqueous liquid applied to the undrawn filaments was an aqueous dispersion containing 0.5% by weight of a hydrophobic silica (which was available under the trademark Tullanox 500, produced by Tulco Inc., in the form of fine particles having an average size of 7 millimicrons), and 0.5% by weight of a dispersing agent consisting of a polyoxyethylenenonylphenolether.

In Comparative Example 4, the same procedures as those described in Example 5 were carried out except that the aqueous liquid applied to the undrawn filaments was an aqueous dispersion containing 0.5% by weight of hydrated aluminum silicate.

The properties of the resultant filaments of Example 5 and Comparative Example 4 are shown in Table 3.

TABLE 3

| Item | Example 5 | Comparative Example 4 |
|---|---|---|
| Thickness (d) | 1479 | 1475 |
| Tensile strength (g/d) | 26.3 | 25.4 |
| Ultimate elongation (%) | 4.1 | 4.0 |
| Initial modulus of elasticity (g/d) | 629 | 628 |
| Degree of adhesion | 1.01 | 1.85 |

EXAMPLE 6 AND COMPARATIVE EXAMPLE 5

The same procedures as those described in Example 1 were carried out except that an aqueous liquid containing 1% by weight of talc particles having a size of 1.5 microns and 0.25% by weight of hydrated aluminum silicate was applied to the undrawn filaments, and then an additional liquid containing 0.5% by weight of a polyethyleneglycol having an average molecular weight of 1,000,000 (which was available under the trademark Alcocks E-60 made by Meisei Chemical Industry Co., Ltd., Japan) was applied to the undrawn filaments. After the drying step, the sum amount of the talc, hydrated aluminum silicate, and polyethyleneglycol covering the undrawn filament surfaces was 0.6% by dry weight based on the weight of the dried undrawn filaments.

In Comparative Example 5, the same procedures as those described in Example 6 were carried out, except that no talc was used.

The properties of the drawn filaments of Example 6 and Comparative Example 5 are shown in Table 4.

TABLE 4

| Item | Example 6 | Comparative Example 5 |
|---|---|---|
| Thickness (d) | 1485 | 1475 |
| Tensile strength (g/d) | 26.2 | 25.4 |
| Ultimate elongation (%) | 4.2 | 4.0 |
| Initial modulus of elasticity (g/d) | 630 | 628 |
| Degree of adhesion | 1.01 | 1.85 |
| Number of fluffs per 1000 m | 1 | 183 |
| Number of breakages per hr. | 0.01 | 0.8 |

EXAMPLES 7 TO 10

In each of Examples 7 to 10, the same procedures as those described in Example 1 were carried out, with the following exception.

The spinneret had 250 holes, each having a diameter of 0.3 mm. The extruding rate of the dope solution through the spinneret was 93 g/min. The coagulated undrawn filaments were withdrawn at a speed of 15 m/min from the coagulating liquid. The undrawn filaments were immersed in an aqueous liquid containing particles of inert inorganic material indicated in Table 5 and having the size indicated in Table 5, for one second, squeezed between a rubber roll and a metal roll, and finally dried. The undrawn filament surfaces were evenly covered by the fine particles of the inert inorganic material in the amount indicated in Table 5, based on the weight of the dried undrawn filaments. The dried undrawn filaments covered by the inert inorganic material passed through a hollow pipe having an effective length of 1 m and a rectangular cross-sectional profile having an inner width of 40 mm and an inner thickness of 5 mm, and being provided a number of holes each having a diameter of 4 mm and formed in the peripheral surface of the pipe in a distribution density of one hole per 2.3 $cm^2$ of the peripheral surface of the pipe. Superheated steam was introduced into the hollow pipe through the holes at a flow rate of 600 l/min, so that the temperature of the steam atmosphere in the hollow pipe was controlled to 505° C. The temperature of the undrawn filaments was elevated to a level of about 495° C. The undrawn filaments were drawn in the hollow pipe at a draw ratio of 12.0, without touching the inside surface of the pipe.

The properties of the resultant drawn filaments are shown in Table 5.

TABLE 5

| Example No. | Inert inorganic material: Type | Average size (μ) | Amount* (%) | Tensile strength (g/d) | Ultimate elongation (%) | Degree of adhesion |
|---|---|---|---|---|---|---|
| 7 | Colloidal graphite | 0.3 | 0.7 | 26 | 4 | 1.02 |
| 8 | Colloidal silica | 0.005 | 0.7 | 26 | 4 | 1.03 |
| 9 | Talc | 1.5 | 0.8 | 26 | 4 | 1.01 |
| 10 | Mixture of talc with hydrated aluminum | 1.5~10 | 0.7 | 26 | 4 | 1.01 |

TABLE 5-continued

| Example No. | Inert inorganic material Type | Average size (μ) | Amount* (%) | Tensile strength (g/d) | Ultimate elongation (%) | Degree of adhesion |
|---|---|---|---|---|---|---|
| | silicate (1:1 by weight) | | | | | |

Note
*Amount of inert inorganic material adhered to filaments

In each of Examples 7 to 10, the drawing operation was continued for 24 hours without difficulty and the resultant drawn filaments exhibited a satisfactory softness.

EXAMPLE 11

The same procedures as those described in Example 7 more carried out except that the aqueous dispersion containing 3% by weight of talc particles having an average size of 3 microns, 0.18% by weight of a dispersing agent consisting of sodium hexametaphosphate and 0.35% by weight of polyethyleneglycol having a molecular weight of about 1,000,000 was applied to the undrawn filaments. The total amount of talc, the dispersing agent, and polyethylenglycol adhered to the undrawn filament surfaces was 0.9% based on the weight of the filaments. The drawing process was carried out very smoothly and without difficulty.

The resultant drawn filaments exhibited a tensile strength of 26 g/d, an ultimate elongation of 4%, a degree of adhesion of 1.01, and a satisfactory softness.

EXAMPLES 12 TO 14

In each of Examples 12 to 14, the same procedures as those described in Example 7 were carried out, except that the amount of talc adhered to the undrawn filaments was 0.7% by dry weight based on the weight of the undrawn filaments and the inside of the hollow pipe was heated with a heating medium indicated in Table 7.

The properties of the resultant drawn filaments are as shown in Table 6.

TABLE 6

| Example No. | Heating medium | Tensile strength (g/d) | Ultimate elongation (%) | Degree of adhesion | Softness |
|---|---|---|---|---|---|
| 12 | Steam | 26 | 4 | 1.01 | Satisfactory |
| 13 | Air | 25 | 4 | 1.02 | " |
| 14 | Nitrogen | 25 | 4 | 1.02 | " |

EXAMPLE 15

The same procedures as those described in Example 10 were carried out except that the wholly aromatic polyamide had an inherent viscosity of 4.0 and consisted of 50 molar % of recurring units of the formula,

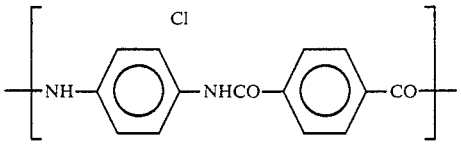

and 50 molar % of recurring units of the formula,

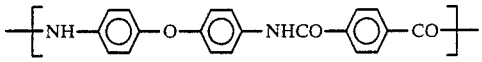

the temperatures of the steam atmosphere and filaments in the hollow pipe were 460° C. and about 430° C., respectively.

The drawing operation was smoothly carried out and the resultant drawn filaments had a tensile strength of 23 g/d, an ultimate elongation of 4%, a degree of adhesion of 1.0, and a satisfactory softness.

EXAMPLE 16 AND 17

In Example 16, the same procedures as those described in Example 1 were carried out except that the spinneret had 500 holes, each having a diameter of 0.2 mm, the extruding rate of the dope solution was 470 g/min, and an aqueous liquid contained 0.35% by weight of hydrated colloidal silica (made by Nissan Chemical Industry Co., Ltd. and available under the trademark Snowtex 20) was dissolved in pure water.

The drawing operation was carried out smoothly without breakage of the filaments, and the resultant drawn filaments exhibited a denier of 767, a tensile strength of 26.2 g/d, an ultimate elongation of 4.5%, an initial modulus of elasticity of 615 g/d, and a degree of adhesion of 1.02.

In Example 17, the same procedures as those described in Example 16 were carried out, except the colloidal silica was replaced by fine particles of colloidal mica having a length of from 1 to 5 microns and a thickness of about 5 microns.

The drawing operation was smoothly carried out and the resultant drawn filaments had a denier of 767, a tensile strength of 26.0 g/d, an ultimate elongation of 4.4%, and a degree of adhesion of 1.03.

EXAMPLES 18 TO 21 AND COMPARATIVE EXAMPLES 6 AND 7

In each of Example 18 to 21, a wholly aromatic polyamide having an inherent viscosity of 3.5 and consisting of the same two types and amounts of recurring units as those described in Example 1, was prepared.

The polyamide was dissolved in a concentration of 6% by weight in a solvent consisting of N-methyl-2-pyrrolidone containing a small amount of calcium chloride to provide a dope solution. The resultant dope solution was extruded through a spinneret having 1000 holes, each having a diameter of 0.3 mm, at an extruding rate of 1100 g/min. The resultant filamentary streams of the extruded dope solution passed through the air atmosphere for 8 mm and were then introduced into the same coagulating liquid as that described in Example 1. The resultant coagulated filaments were taken up from the coagulating liquid at a speed of 40 m/min and washed with hot water at a temperature of 50° C.

The resultant undrawn filaments were immersed for 4 seconds in an aqueous dispersion containing fine particles of talc and hydrated aluminum silicate, respectively, in the amounts indicated in Table 7, were squeezed between a rubber roll and a metal roll, and were than dried by blowing hot air toward the filaments at a temperature of about 300° C.

The sum of the amounts of talc and hydrated aluminum silicate adhered to the undrawn filament surfaces was about 1% based on the weight of the undrawn filaments.

The dried undrawn filaments were directly subjected to a two step drawing procedure wherein, in the first step, the undrawn filaments were brought into contact with a heating plate having a length of 200 cm, were drawn at a temperature of 360° C., and at a draw ratio of 2.0 and, in the second step, the first drawn filaments were brought into contact with a heating plate having a length of 300 cm, were drawn at a temperature of 500° C., and at a draw ratio of 5.0.

The resultant filaments had a thickness of about 1500 deniers.

The aqueous dispersion was prepared by mixing the predetermined amounts of talc particles having an average size of 5 microns or less and hydrated aluminum silicate particles having an average size of 5 microns or less into water containing 3%, based on the sum of the weights of talc and hydrated aluminum silicate, of sodium hexametaphosphate, and by stirring the resultant aqueous mixture so as to uniformly disperse the talc and hydrated aluminum silicate in water.

The properties of the resultant drawn filaments are indicated in Table 7.

In Comparative Example 6 and 7, the same procedures as those above-mentioned were carried out, except that no talc was used in Comparative Example 6 and no talc and hydrated aluminum silicate were used in Comparative Example 7. The properties of the resultant comparative filaments are shown in Table 7.

TABLE 7

| Example No. | | Weight ratio of talc to hydrated aluminum silicate | Drawn filaments Tensile strength (g/d) | Ultimate elongation (%) | Degree of adhesion |
|---|---|---|---|---|---|
| Example | 18 | 95/5 | 25.5 | 4.6 | 1.02 |
| | 19 | 80/20 | 25.6 | 4.5 | 1.01 |
| | 20 | 70/30 | 26.0 | 4.6 | 1.02 |
| | 21 | 50/50 | 25.6 | 4.5 | 1.03 |
| Comparative Example | 6 | 0/100 | 25.4 | 4.4 | 1.85 |
| | 7 | none | 25.5 | 4.5 | 4.8 |

In each of Examples 18 to 21, the drawing operation was carried out smoothly and without difficulty, and in the resultant drawn filament bundle, substantially no fluffs and loops were found.

In Comparative Example 6, the drawing operation per se was satisfactorily carried out. However, the resultant drawn filament bundle exhibited an unsatisfactorily large degree of adhesion of the individual filaments and had a considerable numbers of fluffs and loops formed therein.

In Comparative Example 7, the drawing operation was not smooth, because of the frequent opening of the filament bundle, and the resultant drawn filament bundle had a number of fluffs and loops formed therein.

Table 7 clearly shows that the bundling agent consisting of hydrated aluminum silicate is highly effective for causing the drawing procedure to be smooth and for preventing undesirable adhesion of the individual filaments to each other, and undesirable formation of fluffs and/or loops in the resultant drawn filament bundle.

EXAMPLES 22 TO 24

In each of Examples 22 to 24, the same procedures as those described in Example 18 were carried out, except that the washed undrawn filament bundle was immersed in an aqueous dispersion containing fine particles of talc and sodium hexametaphosphate, was squeezed in the same manner as that mentioned in Example 18, and then immersed in an aqueous dispersion containing hydrated aluminum silicate, was squeezed, and was finally dried in the same manner as described in Example 18.

The undrawn filaments had talc and hydrated aluminum silicate adhered thereto in the dry amounts indicated in Table 8, based on the weight of the undrawn filaments.

The drawing procedures in each of Examples 22 to 24 were smoothly carried out substantially without opening of the filament bundle, and the resultant drawn filament bundle had substantially no fluffs and loops formed thereon.

The resultant filaments had the properties indicated in Table 8.

TABLE 8

| Example No. | Adhered amount Talc (%) | Hydrated aluminum silicate (%) | Drawn filament Tensile strength (g/d) | Ultimate elongation (%) | Degree of adhesion |
|---|---|---|---|---|---|
| 22 | 0.9 | 0.2 | 25.3 | 4.3 | 1.01 |
| 23 | 0.6 | 0.6 | 25.5 | 4.4 | 1.02 |
| 24 | 0.4 | 0.6 | 25.2 | 4.2 | 1.02 |

EXAMPLES 25 AND 26

In Example 25, the same procedures as those described in Example 19 were carried out, with the following exception.

After the undrawn filament bundle was treated with the aqueous dispersion containing fine particles of talc and hydrated aluminum silicate, squeezed and then dried at a temperature of 300° C., and an aqueous solution containing 2% by weight of a copolymer consisting of 30 molar % of polypropyleneoxide component and 70 molar % of polyethyleneoxide component and having a molecular weight of approximately 20,000 was applied to the individual filaments surfaces by using a usual oiling roll. The dried undrawn filament bundle contained approximately 0.9% of the mixture of talc and hydrated aluminum silicate and approximately 0.3% of the copolymer based on the dry weight of the undrawn filament bundle.

The undrawn filaments bundle was subjected to the same drawing procedures as those described in Example 7. The resultant drawn filament bundle had a thickness of 1500 denier/1000 filaments.

In Example 26, the same procedures as those described in Example 23 were carried out, with the following exception.

After the undrawn filament bundle was adhered with talc particles and then hydrated aluminum silicate particles, the undrawn filament bundle was treated with the same polymer solution in the same manner as described in Example 25.

The sum amount of talc and hydrated aluminum silicate and the amount of the copolymer adhered to the undrawn filaments were about 1.2% and about 0.3% based on the dry weight of the undrawn filaments, respectively.

In each of Examples 25 and 26, the drawing procedure was very smoothly carried out without opening of the filament bundle and the resultant drawn filament bundle had no loops and a negligible number of fluffs, and exhibited the properties indicated in Table 10.

TABLE 9

| Example No. | Tensile strength (g/d) | Ultimate elongation (%) | Degree of adhesion |
|---|---|---|---|
| 25 | 25.5 | 4.5 | 1.02 |
| 26 | 25.8 | 4.4 | 1.01 |

We claim:

1. A process for producing wholly aromatic polyamide filaments heat-treated under tension, comprising the steps of:

adhering fine particles consisting essentially of an inert inorganic material to peripheral surfaces of wholly aromatic polyamide filaments to be heat-treated under tension and comprising at least one wholly aromatic polyamide having recurring units of the formula (I):

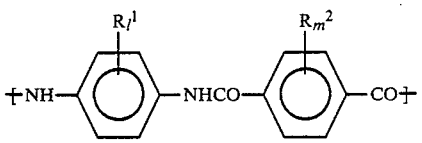

(I)

and at least one type of recurring units selected from those of the formula (II):

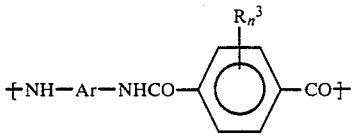

(II)

wherein Ar represents a divalent aromatic radical selected from those of the formulae (III) and (IV):

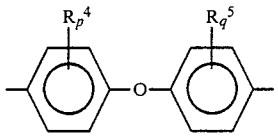

(III)

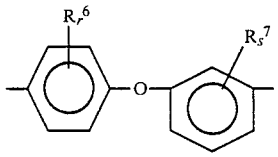

(IV)

and $R^1$, $R^2$, $R^3$, $R^4$, $R^5$, $R^6$ and $R^7$ respectively represent independently from each other, a substituent selected from the group consisting of halogen atoms and alkyl radicals having 1 to 2 carbon atoms, and l, m, n, p, q, r, and s respectively represent, independently from each other, zero or an integer of 1 to 2, the sum of said recurring units of the formulae (I) and (II) corresponding to at least 80 molar % of the overall recurring units in said wholly aromatic polyamide to such an extent that the peripheral surface of said non-heat treated filaments are uniformly covered with said inert inorganic material fine particles in an amount of from 0.01% to 5% based on the weight of said non-heat treated filaments; and heat-treating under tension said non-heat treated filaments covered with said inert inorganic material fine particles at a temperature of 300° C. or more, in which process said adhering operation is carried out by applying an aqueous liquid containing said inert inorganic material and then by drying the applied aqueous liquid on said non-heat treated filaments and said inert inorganic material consists essentially of at least one member selected from the group consisting of graphite, talc, colloidal silica, hydrophobic silica and mica.

2. The process as claimed in claim 1, wherein said inert inorganic material fine particles adhered to said non-heat treated filaments have an average size of 10 microns or less.

3. The process as claimed in claim 1, wherein said aqueous liquid containing said inert inorganic material fine particles additionally contains a coverging agent comprising hydrated aluminum silicate.

4. The process as claimed in claim 3, wherein the applying procedure of said aqueous liquid containing said inert inorganic material fine particles and said converging agent is followed by applying an aqueous liquid containing an additional converging agent comprising polyakyleneglycol to said non-heat treated filament peripheral surfaces.

5. The process as claimed in claim 1, wherein the applying procedure of said aqueous liquid containing said inert inorganic material fine particles is followed by applying an aqueous liquid containing a converging agent comprising hydrated aluminum silicate to the peripheral surfaces of said non-heat treated filaments.

6. The process as claimed in claim 5, wherein the applying procedure of said converging agent-containing aqueous liquid is followed by applying an aqueous liquid of an additional converging agent comprising polyalkyleneglycol to the peripheral surfaces of said non-heat treated filaments.

7. The process claimed in claim 1, wherein said aqueous liquid containing said inert inorganic material fine particles additionally contains a dispersing agent comprising sodium hexametaphosphate in an amount of from 0.1% to 5% based on the weight of said inorganic material fine particles.

8. The process as claimed in claim 3, 4, or 5, wherein the hydrated aluminum silicate adheres in an amount of from 0.01% to 3% based on the weight of said non-heat treated filaments.

9. The process as claimed in claim 4 or 6, wherein the polyalkyleneglycol adheres in an amount of from 0.01% to 3% based on the weight of said non-heat treated filaments.

10. The process as claimed in claim 4, wherein said aqueous liquid contains talc and hydrated aluminum silicate in an weight ratio of 50:50 to 95:5.

11. The process as claimed in claim 1, wherein in said wholly aromatic polyamide, the content of the recurring units of the formula (I) is in the range of from 20 to 85 molar %.

12. The process as claimed in claim 1, wherein in said wholly aromatic polyamide, the content of the recurring units of the formula (II) is in the range of from 15 to 80 molar %.

13. The process as claimed in claim 1, wherein in said wholly aromatic polyamide, the content of the recurring units of the formula (II) in which the divalent aromatic radical Ar is of the formula (IV) is in the range of from 15 to 80 molar %.

14. The process as claimed in claim 1, wherein said inert inorganic material fine particles in said aqueous dispersion or collidal solution are in a content of from 0.1% to 10% by solid weight.

15. The process as claimed in claim 1, wherein in said heat-treating procedure under tension, said non-heat treated filaments are drawn at a draw ratio of at least 3.0.

16. The process as claimed in claim 1, wherein said heat-treating procedure under tension is carried out by bringing said non-heat treated filaments into contact with a heating plate having a temperature of from 300° C. to 550° C., while said filaments pass through a heat-treating path.

17. The process as claimed in claim 1, wherein said heat-treating procedure under tension is carried out by passing said filaments through a heating atmosphere having a temperature of from 300° C. to 600° C.

* * * * *